United States Patent [19]

Chinenson

[11] 4,169,596

[45] Oct. 2, 1979

[54] BOARD GAME INCLUDING THROWABLE PLAYING PIECES

[76] Inventor: Benjamin Chinenson, Hata'as St. 24, Givatayim, Israel

[21] Appl. No.: 841,291

[22] Filed: Oct. 12, 1977

[51] Int. Cl.[2] ..... A63F 9/02

[52] U.S. Cl. ..... 273/95 R; 273/95 E; 273/105 R; 273/106 R

[58] Field of Search ..... 273/95 E, 106 R, 105 R, 273/123 R, 58 R, 58 F, 282, 113, 115, 95 R, 127 R

[56] References Cited

U.S. PATENT DOCUMENTS

| | | | |
|---|---|---|---|
| 456,171 | 7/1891 | Swaney | 273/123 R |
| 607,031 | 7/1898 | Gilbert | 273/123 R |
| 631,004 | 8/1899 | Burns | 273/113 |
| 810,352 | 1/1906 | Sackett | 273/106 R |
| 1,174,411 | 3/1916 | Halton | 273/123 R |
| 1,687,775 | 10/1928 | Lestage | 273/95 R |

*Primary Examiner*—William H. Grieb

*Attorney, Agent, or Firm*—Benjamin J. Barish

[57] ABSTRACT

A game is described comprising a board having a cup-shaped member located at its center and a plurality of pockets, one for each player, located at the corners of the board. The pockets are adapted to hold a plurality of playing pieces all of the same configuration and each including a curved external surface contour to enable two of the playing pieces to be held together in substantially point contact at their curved surfaces and to be thrown together against an inner wall of the cup in an attempt to have one playing piece remain in the cup and the other to bounce out of the cup.

6 Claims, 15 Drawing Figures

A
A
II
II

BOARD GAME INCLUDING THROWABLE PLAYING PIECES

BACKGROUND OF THE INVENTION

The present invention relates to games involving skill as well as chance, and particularly to a game that may be played by a plurality of players each competing against the others in an attempt to win the maximum number of playing pieces from the others.

SUMMARY OF THE INVENTION

According to a broad aspect of the invention, there is provided a game comprising a board adapted to rest on a flat horizontal surface; a cup-shaped member located at a centre portion of the board; and a plurality of pockets, one for each player, for holding playing pieces, the pocket being located along the outer margins of the board. The game further comprises a plurality of playing pieces having the same configuration, each playing piece including a curved external surface of contour to enable two of the playing pieces to be held together in substantially point contact at their curved surfaces and to be thrown together against an inner wall of the cup-shaped member in an attempt to have one playing piece remain in the cup and the other to bounce out of the cup.

Such a game may be played according to the following rules: The playing pieces are all divided among the players, each receiving an equal number. Each player in his turn holds two of his playing pieces together between his fingers in one hand, with their external curved surfaces in contact with each other, and throws the two playing pieces together against an inner wall of the cup. The object is to throw them such that one playing piece will remain in the cup and the other will bounce out of the cup.

If the player succeeds in this, he wins all the playing pieces in the cup; but if both playing pieces remain in the cup, or both flying out of the cup, he must add his two playing pieces to the cup, where they remain and accumulate until the subsequent player succeeds in his throw.

Some skill is required in playing the game, in addition to chance, since if both playing pieces are thrown into the cup haphazardly, the likelihood is that they will both bounce out of the cup or will both remain in the cup. The idea is to hold the two playing pieces with their curved surfaces in point contact with each other and oriented with respect to the cup wall such that when they are thrown together against the cup wall, one playing piece will hit the cup wall and will transmit the force of impact to the other playing piece along the point of contact in a direction to cause the latter playing piece to bounce out of the cup, while the first playing piece, its energy having been spent in transferring the force to the second playing piece, remains in the cup.

The game, particularly the playing pieces used, may take many different forms. Particularly good results have been found when their curved surfaces are ellipsoidal or spherical. Embodiments of the invention are described below in which the playing pieces are each of symmetrical configuration and include the same curved surface on both sides of its axial plane. Also described, however, are embodiments wherein the playing pieces are of unsymmetrical configuration.

Further embodiments of the invention are also described wherein the playing pieces are of solid construction or of hollow construction, the hollow construction being empty, or including a freely-movable core or other core material.

Further features and advantages of the invention will be apparent from the description below.

BRIEF DESCRIPTION OF THE DRAWINGS

The invention is described herein, by way of example only, with reference to the accompanying drawings, wherein.

DESCRIPTION OF THE PREFERRED EMBODIMENT

Figures 1, 2, 3A, 3B, 3C, 4, 4A, 5A, 5B, 5C, 5D, 6A, 6B, 6C, 6D:
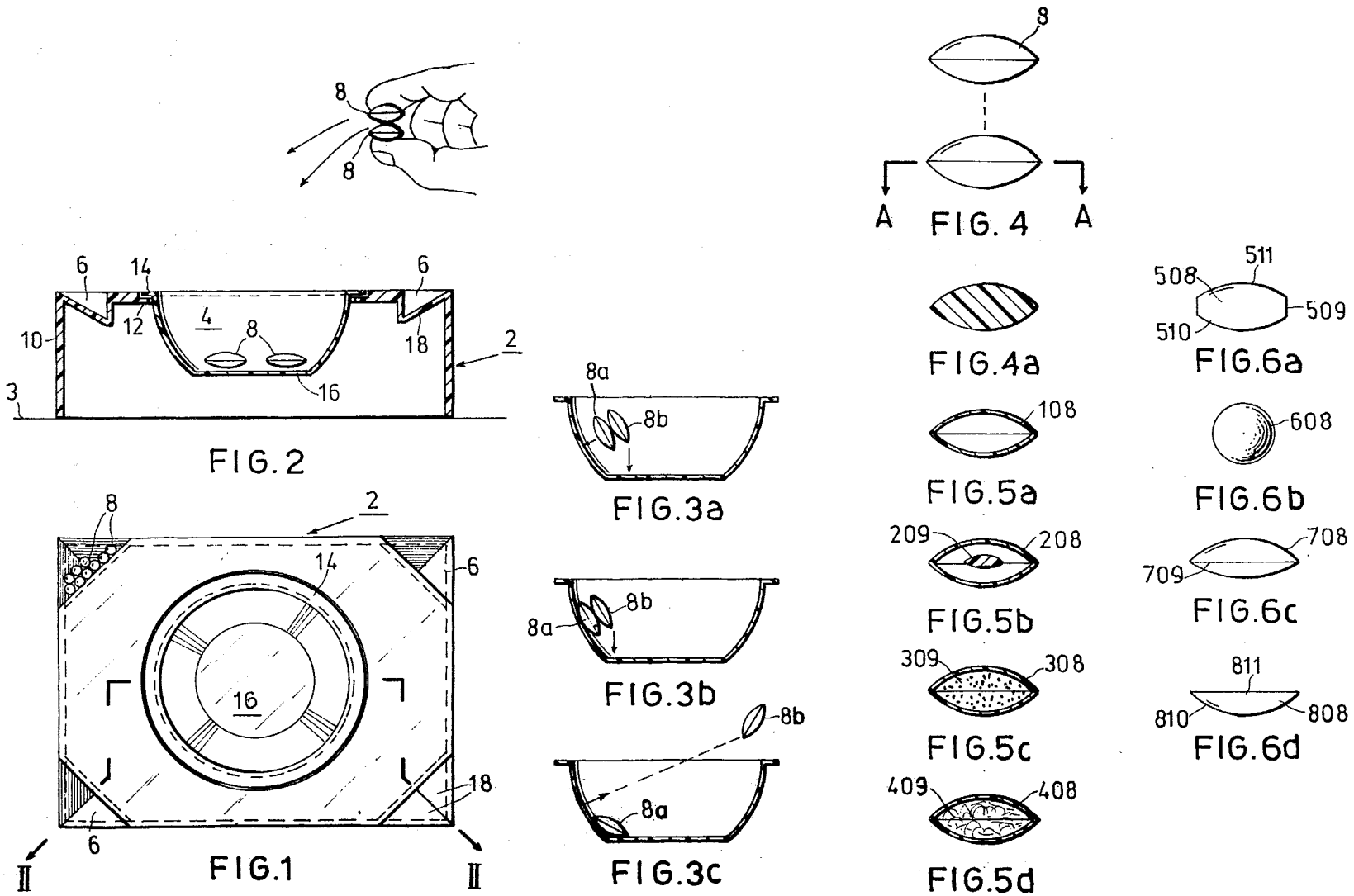
FIG. 1 illustrates one form of game constructed in accordance with the invention and the manner of playing it.
FIG. 2 is an enlarged sectional view along lines II—II of the board in FIG. 1.
FIGS. 3*a*–3*c* schematically illustrate what occurs during a successful "throw" in playing the game.
FIG. 4 illustrates two of the playing pieces in the game of FIG. 1.
FIG. 4*a* is a sectional view along lines A—A of FIG. 4.
FIGS. 5*a*–5*d* are views corresponding to that of FIG. 4*a* but illustrating further different constructions that may be used for the playing pieces.
FIGS. 6*a*–6*d* illustrate further different configurations that may be used for the playing pieces.

With reference to FIG. 1, the game described herein comprises a board, generally designated 2, adapted to rest on a flat horizontal surface 3 (FIG. 2) such as a table top. The board includes a cup-shaped member 4 located at its centre, and a plurality of pockets 6, one for each player, for holding a plurality of playing pieces 8 to be played by the players. The pockets 6 are preferably located at the four corners of the board 2, to permit up to four players to play the game, but it will be appreciated that a larger, or smaller, number of pockets could be provided located at desired locations along the outer margin of the board.

The construction of the board 2, including the centre cup 4 and the pockets 6, is more particularly illustrated in FIG. 2. The board 2 may be of shaped (e.g. vacuum-shaped) plastic sheet material of rectangular configuration and formed with four vertical depending walls 10 for resting on the flat horizontal surface 3, such as a table top. The centre of the board 2 is spaced from horizontal surface 3 and is formed with a circular opening bordered by a recessed margin serving as a ledge, as shown at 12, for receiving an outer annular rim 14 formed on the cup-shaped member 4. The latter is suspended by its rim 14 from ledge 12 of the board 2 such that the rim of the cup-shaped member 4 is substantially flush with the board 2, and the bottom 16 of the cup-shaped member is spaced above the horizontal supporting surface 3 on which the board 2 rests. The depth of the cup-shaped member 4 is many times the size of the playing pieces 8, its walls being preferably made of hard material to produce a strong bounce to the playing pieces 8 when thrown against it.

The pockets 6 for holding the playing pieces 8 are of triangular shape following the configuration of the corners of the board 2, as shown in FIG. 1. Preferably they each include a bottom wall 18 inclined upwardly towards the outer margin of the board where they join with the vertical walls 10. Pockets 6 may be conveniently formed integrally with the board 2 by vacuum shaping or molding techniques.

The construction of the playing pieces 8 is more particularly illustrated in FIG. 4. As noted above, these playing pieces are all of the same configuration and include a curved external surface to enable two of the playing pieces to be held together in substantially point contact at their curved surfaces when they are thrown together into the cup 4. FIG. 4 illustrates these curved surfaces as of substantially ellipsoidal configuration.

FIGS. *3a–3c* illustrate a successful "throw", wherein the two playing pieces are thrown against the wall of the cup 4 such that one playing piece remains within the cup and the other bounces out. Thus, both playing pieces 8*a*, 8*b*, are thrown together with their two curved surfaces in point contact with each other (FIG. 3*a*), such that when the first playing piece 8*a* impacts against the wall of cup 4 (FIG. 3*b*), the second playing piece 8*b* will be located with respect to the first one so as to receive a force from it and to be bounced out of the cup, while the first playing piece 8*a*, its force now spent, remains in the cup (FIG. 3*c*).

When playing the game, each player will throw two playing pieces in his turn, and if he succeeds in having one playing piece remain in the cup with the second one bouncing out, he will win all the playing pieces then in the cup. If he fails in his throw (i.e. both playing pieces remain in the cup, or both bounce out), the player must leave the two played playing pieces within the cup 4, and the turn then passes to the next player. Accordingly, the playing pieces tend to accumulate within the cup as a result of unsuccessful throws, and when one finally makes the successful throw, as described above, he wins all the playing pieces then in the cup.

The playing pieces 8 may be made of moulded plastic material. FIGS. *5a–5d* illustrate a number of constructions, other than the solid construction of FIG. 4*a*, that they may take; and FIGS. *6a–6d* illustrate a number of other possible configurations, other than the symmetrical ellipsoidal configuration of FIG. 4.

Thus, FIG. 5*a* illustrates the playing piece 108 as being of a hollow construction; FIG. 5*b* illustrates the playing piece 208 as being of a hollow construction but including a freely-movable core 209, e.g. of plastic; FIG. 5*c* illustrates the playing piece 308 as being of hollow construction but including granular or particulate material 309; and FIG. 5*d* illustrates the playing piece 408 as being of hollow construction but including flocculent material 409. All these constructions have a slightly different bounce effect when thrown against the cup wall.

With respect to different configurations of the playing pieces, FIG. 6*a* illustrates the playing piece of a configuration similar to that of FIG. 4 except that it includes a substantially cylindrical wall section 509 centrally of the playing piece, the two opposed sections 510, 511 being curved according to an ellipsoidal or other curved configuration. FIG. 6*b* shows the playing piece 608 of a spherical configuration. In FIG. 6*c*, the playing piece 708 is shown as being of an unsymmetrical construction (rather than a symmetrical construction as in the preceding figures) about its axial plane 709. In FIG. 6*d*, the playing piece 808 is also unsymmetrical, including a curved surface 810 on one side, and a flat surface 811 on the opposite side.

Many variations can be made in the rules of play. For example, the rules could provide that a "win" results when an odd number (not necessarily one) of playing pieces bounce out of the cup whereas a "lose" results in none or an even number bounce out.

Many other variations, modifications and applications of the invention may be made.

What is claimed is:

1. A game, comprising: a board of flat sheet material formed with depending walls adapted to rest on a flat horizontal surface with the center portion of the board spaced from said surface; a cup-shaped member located at the center portion of the board and depending therebelow with the rim of the cup-shaped member substantially flush with the board, and with the bottom of the cup-shaped member suspended above the horizontal surface; a plurality of pockets, one for each player, for holding playing pieces, said pocket being located along the outer margins of the board; and a plurality of playing pieces having the same configuration, each playing piece including a curved external surface to enable two of the playing pieces to be held together in substantially point contact at their curved surfaces and to be thrown together against an inner wall of the cup-shaped member in an attempt to have one playing piece remain in the cup and the other to bounce out of the cup; said cup-shaped member having a depth many times the size of said playing pieces.

2. A game according to claim 1, wherein said curved external surface of the playing pieces is substantially ellipsoidal.

3. A game according to claim 1, wherein said playing pieces are each of a hollow construction.

4. A game according to claim 3, wherein said playing pieces include a free-movable core within its hollow construction.

5. A game according to claim 1, wherein said pockets are formed at the corners of the board, are of triangular shape, and have a bottom wall inclined upwardly towards the outer margin of the board.

6. A game according to claim 1, wherein said cup-shaped member is formed separately of the board and removably rests thereon.

* * * * *